United States Patent [19]

Bolza-Schunemann

[11] Patent Number: 4,782,753

[45] Date of Patent: Nov. 8, 1988

[54] PRINTING COUPLE FOR NEWSPAPER AND PERIODICAL PRINTING

[75] Inventor: Hans-Bernhard Bolza-Schunemann, Wurzburg, Fed. Rep. of Germany

[73] Assignee: Koenig & Bauer Aktiengesellschaft, Wurzburg, Fed. Rep. of Germany

[21] Appl. No.: 534,459

[22] Filed: Sep. 21, 1983

[30] Foreign Application Priority Data

Oct. 13, 1982 [DE] Fed. Rep. of Germany ..... 3237686

[51] Int. Cl.[4] ..... B41F 11/00

[52] U.S. Cl. ..... 101/363; 101/350; 101/DIG. 28; 101/217

[58] Field of Search ..... 101/348–352, 101/363, 217, DIG. 28

[56] References Cited

U.S. PATENT DOCUMENTS

| | | | |
|---|---|---|---|
| 3,238,870 | 3/1966 | Matkovich et al. | 101/363 |
| 3,559,572 | 2/1971 | Hackley | 101/350 |
| 3,585,932 | 6/1971 | Granger | 101/350 |
| 3,793,952 | 2/1974 | Neumann et al. | 101/351 |
| 3,889,596 | 6/1975 | Thomas et al. | 101/352 |
| 4,290,362 | 9/1981 | Kobler et al. | 101/363 |
| 4,301,728 | 11/1981 | Jaffe et al. | 101/350 |
| 4,309,945 | 1/1982 | Marion | 101/352 |
| 4,373,443 | 2/1983 | Matalia et al. | 101/363 |
| 4,397,235 | 8/1983 | Fischer | 101/DIG. 28 |
| 4,445,433 | 5/1984 | Navi | 101/350 |

OTHER PUBLICATIONS

"Flexographic Printing" Boughton, USA 1958.

*Primary Examiner*—William Pieprz
*Attorney, Agent, or Firm*—Jones, Tullar & Cooper

[57] ABSTRACT

A switchable printing couple particularly suited for use in newspaper and periodical printing is disclosed. A counter pressure cylinder and plate cylinder cooperate to print a moving paper web. An ink fountain, which does not require ink keys, supplies ink to a hard surfaced screen roller. Ink from the screen roller is transferred either directly to an elastic flexographic printing plate or indirectly through ink cylinders to a hard letterpress printing plate. The screen roller which dips into an ink fountain and from which excess ink can be removed by use of a doctor blade, is capable of being engaged with and lifted off the plate cylinder so that the printing couple can be used either in direct printing with an elastic flexographic printing plate or in indirect printing with a hard letterpress printing plate.

7 Claims, 3 Drawing Sheets

PRINTING COUPLE FOR NEWSPAPER AND PERIODICAL PRINTING

FIELD OF THE INVENTION

The present invention is directed generally to a printing couple. More particularly, the present invention is directed to a printing couple useable with either hard or soft printing plates or formes. Most specifically, the present invention is directed to a printing couple for use with hard or soft printing formes in conjunction with a screen type inking roller. The printing couple includes one or more inking cylinders which are interposed between the screen roller and the printing plate or forme when this plate is of the hard, letterpress type. Similarly, the intermediate inking roller or rollers are moved out of the inking path so that the ink carrying screen roller is in direct contact with a socalled soft or elastic printing forme or plate of the flexographic type when this type of plate is being used. The printing couple in accordance with the present invention eliminates the need for ink keys in the inking fountain and provides an adaptable machine for use particularly in the printing of newspapers and periodicals.

DESCRIPTION OF THE PRIOR ART

The use of flexographic printing couples is generally known in the art, and these couples have been suggested for use in newspaper and periodical printing equipment. Machines of this type are commonly equipped with a hard, uncovered counter pressure cylinder and a plate cylinder that carries the elastic or soft flexographic letter press printing plate or forme on its surface. This elastic or flexible printing plate is inked directly from a screen roller such as an Anilox roller. These screen rollers have a hard outer surface, comprised of a large number of small cells or recesses. The thickness of the ink film that the screen roller transfers from the ink fountain or other ink supply source to the elastic printing plate is determined by the depth and number of these recesses. The screen roller is inked to excess by dipping into ink, by contacting an inking roller, or by having ink sprayed against it. The surplus ink is then removed from the surface of the screen roller by a doctor blade or an ink metering roller.

The flexographic printing couple, as discussed above, has not found wide acceptance in the printing of newspapers or periodicals because of the nature of the elastic letterpress printing plates. These plates are made from special photo-polymers or rubber and require substantial time to manufacture. Hence they are not particularly suitable for newspaper work. Further, the use of such plates in newspaper printing requires a large number of plates and hence a substantial amount of material which makes this type of printing expensive. The elastic, flexible printing plates also often produce .squeezed print edges so that the quality of the printing is adversely affected. To avoid this problem, the plates must be manufactured to extremely precise thickness tolerances so that they will be able to receive ink directly from the screen roller and transfer it to the paper being printed as the paper passes between the elastic printing plate and the hard or non-covered counter pressure cylinder.

Efforts have been made to effect printing through a reversal of the common flexographic printing procedure in an attempt to overcome the difficulties set forth above. A letterpress printing plate or forme, which is made of metal or another hard material such as hard photopolymers such as Nyloprint, is substituted for the elastic plate. This hard printing plate prints against a counter pressure cylinder having a resilient covering of a type known in the art. Since the hard printing forme or plate cannot be inked directly from the hard screen roller, as can be done when an elastic printing plate is used, it is necessary to interpose one or more resilient surfaced elastic forme or plate inking rollers between the screen or Anilox roller and the printing plate.

Hard letterpress printing provides better print quality in newspaper printing than is obtainable with the elastic printing plates. This is due to the absence of squeezed print edges when a hard printing plate is used. However, since the printing plate is not directly inked from the screen roller but instead is inked indirectly, a problem known as "ghosting" can result in printing plates sensitive to this effect. Attempts to overcome this problem have been made by using inking rollers that are equal in size to the plate cylinder and to have them run in a rythmic, non-staggered manner.

The use of the hard screen roller for either direct inking of the flexographic plate or the indirect inking of the hard plate has an advantage of interest to the printer of newspapers and periodicals and this is the elimination of ink keys in the ink fountain. These keys are used with conventional offset or letterpress printing machines and create several problems. They waste paper at print starts until the ink profile for every printing plate has been adjusted. The ink keys often also require expensive systems such as for the remote adjustment of the keys, for the indication of ink relief, and for presetting of ink profiles by the use of scanners and computers. If no ink keys are required, all of these expensive systems can be done away with.

It will be apparent that the printer must, at present, choose between two systems. The flexographic printing couple using a screen roller would be attractive for newspaper and periodical printing if there were less uncertainty about the cost and quality of the flexible printing plates. This direct system of hard counter pressure cylinder, elastic plate and direct plate inking by a hard screen roller is ideal in theory but it is not yet technically perfected. The alternate system using a covered counter pressue cylinder, a hard printing plate, and indirect inking of the plate through elastic intermediate rollers from the hard screen roller is presently practically and economically feasible. However, this system cannot be adapted for use with a flexographic printing plate system which will quite possibly be technically developed in the near future. Thus the printer must, at present select one or the other system since there is nothing available which can use both the hard and soft plates.

SUMMARY OF THE INVENTION

It is an object of the present invention to provide a printing couple for newspaper and periodical printing.

Another object of the present invention, is to provide a printing couple which utilizes a screen inking roller.

A further object of the present invention, is to provide a printing couple having an ink fountain that does not require ink keys.

Yet another object of the present invention, is to provide a printing couple which is capable of being switched between direct and indirect inking of the printing plate.

As will be set forth in greater detail in the description of preferred embodiments, the printing couple in accordance with the present invention can be switched between two inking modes. In the first, the ink is applied directly from the hard screen roller to the elastic flexographic printing plate carried on the plate cylinder. In the alternative or second mode, the ink is transferred from the hard screen roller to an intermediate elastic roller or rollers and then to the hard letterpress printing plate. The printing couple is so structured and supported in the side frames of the printing machine that the positioning of the various cylinders can be arranged to accomplish the switching between soft and hard printing plates. In one embodiment, the screen roller can be positioned to contact either the printing plate or an intermediate inking roller which can contact the plate. In a second embodiment, the size of the screen roller can be varied so that either the screen roller contacts the flexographic plate directly or a smaller diameter roller is used and intermediate inking cylinders are placed between the screen roller and the hard letterpress plate. In a third embodiment, instead of changing the diameter of the screen roller, its axial distance from the plate cylinder is varied.

The printing couple in accordance with the present invention is particularly advantageous for use by printers of newspapers and periodicals since it can be used either with flexographic plates or with hard letterpress plates while still retaining the benefits of the hard screen inking roller. This hard screen Anilox roller has its main advantage in its elimination of the requirement for ink keys.

The printing couple can be used with the hard printing plates currently available. The same printing couple can also be quickly and easily switched over to direct inking for use with the flexographic plates which will quite probably be commerically feasible and available in the near future. Thus the printer of newspapers and periodicals can purchase a printing couple in accordance with the present invention with the knowledge that the equipment possesses the advantages derived from the use of the screen inking roller and will be suitable for use with direct inking of elastic printing plates when these plates have been developed to a point that they perform in a technically satisfactory manner and are available at a competative market price.

BRIEF DESCRIPTION OF THE DRAWINGS

While the novel features of the printing couple for newspaper and periodical printing in accordance with the present invention are set forth with particularity in the appended claims, a full and complete understanding of the invention may be had by referring to the description of preferred embodiments, as set forth hereinafter and as may be seen in the accompanying drawings in which:

DETAILED DESCRIPTION OF PREFERRED EMBODIMENTS

Figure 1:
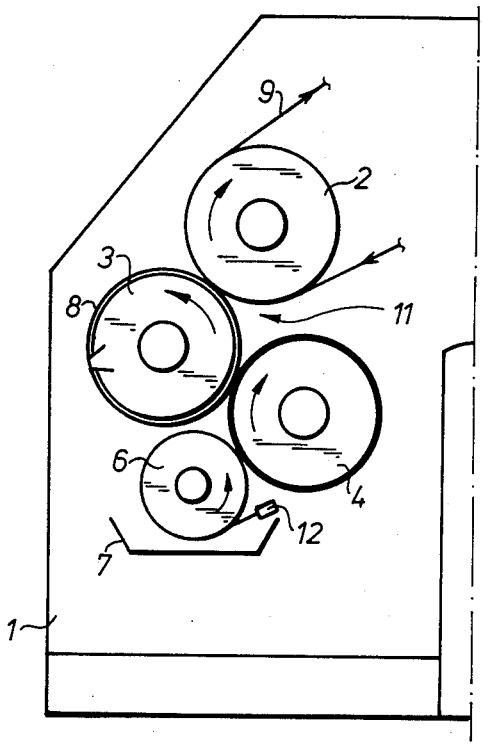
FIG. 1 is a schemetic side elevation view of a first preferred embodiment of a printing couple in accordance with the present invention which is operating with indirect inking.
Figure 2:
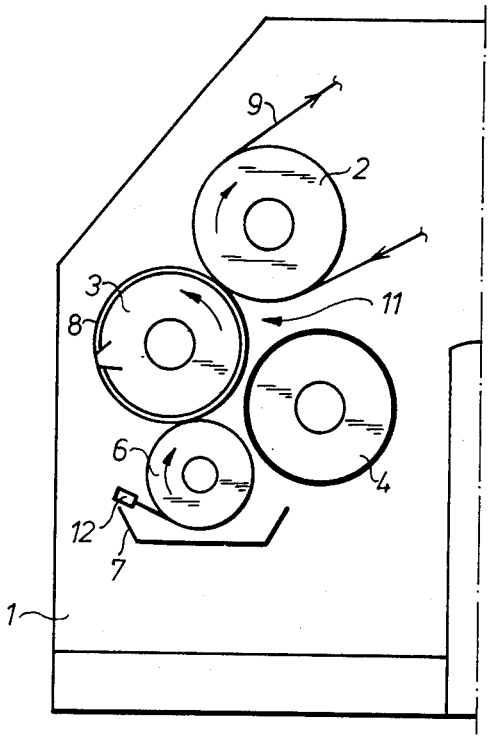
FIG. 2 is a view similar to FIG. 1 but with the printing couple switched to direct inking by repositioning of the screen roller.

Turning now to FIGS. 1 and 2, there may be seen, generally at 11, a first preferred embodiment of a switchable printing couple in accordance with the present invention. The printing couple is comprised of a counter pressure cylinder 2, a forme or plate cylinder 3, and an ink fountain roller 6, all of which are journaled in side frames 1 in a printing machine. The ink fountain roller 6 is a screen roller and has a peripheral surface that is formed with a plurality of small cells or recesses. Such screen rollers or Anilox rollers are known generally in the art. A forme or plate inking cylinder 4 is also provided in printing couple 11. The counter pressure cylinder 2, plate cylinder 3, and inking cylinder 4 are all preferably of equal diameters and are all larger than the screen roller which receives its ink by dipping into an ink fountain 7. A doctor blade 12 is used to remove surplus ink from the surface of the screen roller 6. All of the cylinders in printing couple 11 are driven at equal peripheral speeds by suitable drive means such as spur gears (not shown) in a manner well known in the art.

Counter pressure cylinder 2 is supported in side frames 1 by suitable single eccentric rotatable bearings and can be shifted into and out of engagement with the forme or plate cylinder 3. The inking cylinder 4 is also carried in side frames 1 by suitable single eccentric rotatable bearings and can be shifted into and out of contact with plate cylinder 3. Screen roller 6 is also supported in side frames 1 and is carried by double-eccentrically adjustable bearings so that screen roller 6 can be shifted so that it engages either plate cylinder 3 or inking cylinder 4.

Counter pressure cylinder 2 is equipped with a conventional clamping means (not shown) whereby covers of selectable hardness can be secured to its periphery. Plate or forme cylinder 3 is similarly provided with plate clamping means (not shown) in a conventional manner so that either a hard or an elastic printing plate 8 can be secured about the periphery of plate cylinder 3. A cover, which is capable of accepting in such as rubber, is carried on the surface of the inking cylinder 4. The screen roller, as has been indicated previously, has a hard surface comprised of spaced recesses.

The printing couple, as seen in FIG. 1, is intended for use with a hard letterpress printing plate 8 while the printing couple as seen in FIG. 2 is for use with an elastic flexographic plate. In the position shown in FIG. 1, the hard printing plate 8 is being inked indirectly by the resilient surface of inking cylinder 4 that has been shifted into contact with plate 8. The screen roller is shifted off plate cylinder 3 and into contact with inking cylinder 4. A cover having a degree of resiliency is carried on the surface of counter pressure cylinder 2 and cooperates with the hard printing forme 8 to print a web or sheet of paper 9 passing therethrough. The ink used in printing moves from the ink fountain 7 onto screen roller 6, where surplus ink is removed by doctor blade 12, and then to inking cylinder 4 which inks the hard printing plate 8.

When it is desired to use an elastic flexographic printing plate 8 on plate cylinder 3, the plate inking cylinder 4 is lifted away from the surface of the plate or forme cylinder 3, as may be seen in FIG. 2, and the screen roller 6 is shifted to directly engage the surface of the elastic plate 8. The ink then flows directly from ink fountain 7 to screen roller 6 and onto elastic or flexographic plate 8. It should be noted that the direction of rotation of screen roller 6 and the placement of doctor blade 12 are different depending on whether the inking is indirect, as in FIG. 1 or direct, as in FIG. 2. Thus the printing couple 11 is structured so that by shifting the positions of the inking cylinder and the screen roller, the printing couple can be used either with a hard letterpress printing plate which requires indirect inking or an elastic flexographic printing plate that can be used with direct inking.

Figure 4:
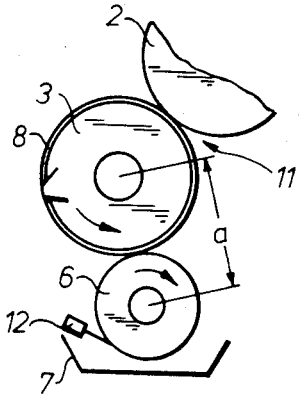
FIG. 4 is a view similar to FIG. 3 but with the printing couple switched to direct inking by substitution of the screen roller
Figure 3:
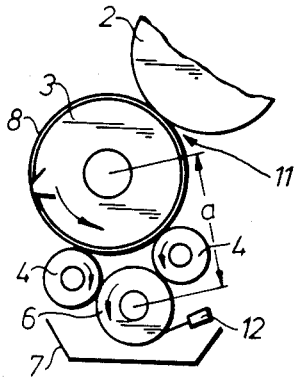
FIG. 3 is a schematic side elevation view of a second preferred embodiment of the printing couple in accordance with the present invention, showning indirect inking.

Referring now to FIGS. 3 and 4, there may be seen a second preferred embodiment, again generally at 11 of a printing couple, in accordance with the present invention. The same numerals are used in this embodiment as in the first embodiment shown in FIGS. 1 and 2 for corresponding elements. In this embodiment, a constant axle distance "a" is maintained between the axis of revolution of the plate or forme cylinder 3 and the screen roller 6 for both direct and indirect inking. In the situation where indirect inking is necessary, as would be required when a hard letterpress printing plate 8 is secured to the plate cylinder 3, as is seen in FIG. 3, the screen roller 6 received ink from ink fountain 7 and transfers the ink to a pair of spaced intermediate inking cylinders 4. The intermediate inking cylinders 4 then transfer the ink to the hard letter press plate 8. A doctor blade 12 is again provided to remove excess ink from the screen roller 6. To switch the printing couple from indirect inking to direct inking, as would be appropriate when an elastic flexographic plate 8 is carried on plate cylinder 3, the two intermediate inking cylinders 4 and the screen roller 6 are removed from the side frames 1 and a larger screen roller 6 is substituted, as may be seen in FIG. 4. The diameter of the substituted screen roller 6 is such that the axle distance "a" remains constant for either direct or indirect inking. It should again be noted that the direction of rotation of the screen roller 6 and the placement of the doctor blade 12 are changed.

Figure 5:
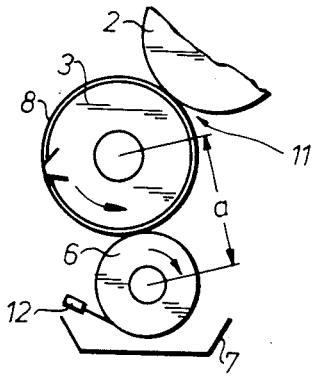
FIG. 5 is a schematic side elevation view of the third preferred embodiment of the printing couple in accordance with the present invention and showing direct inking.
Figure 6:
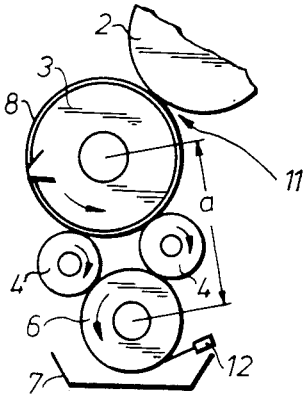
FIG. 6 is a view similar to FIG. 5 but showing indirect inking accomplished by varying the axial spacing between the screen roller and plate cylinder.

A third embodiment of the switchable printing couple may be seen, generally at 11, in FIGS. 5 and 6. Similar numerals are again used to designate corresponding elements in this embodiment. In this third embodiment, indirect inking is shown in FIG. 6 while direct inking may be seen in FIG. 5. This embodiment varies from the previously described second embodiment in that in the third embodiment the distance "a" is varied. The size of the plate cylinder 3 and screen roller 6 remain the same in both direct and indirect inking but the distance "a" is increased for indirect inking to provide space for the placement of the pair of inking cylinders 4 that are situated between the screen roller 6 and the plate cylinder 3. Either the screen roller 6 and ink fountain 7 or the plate cylinder 3 and counter pressure cylinder 2, or both can be moveably carried in the side frames of the printing machine in any conventional manner so that the axle spacing "a" can be varied.

Figure 7:
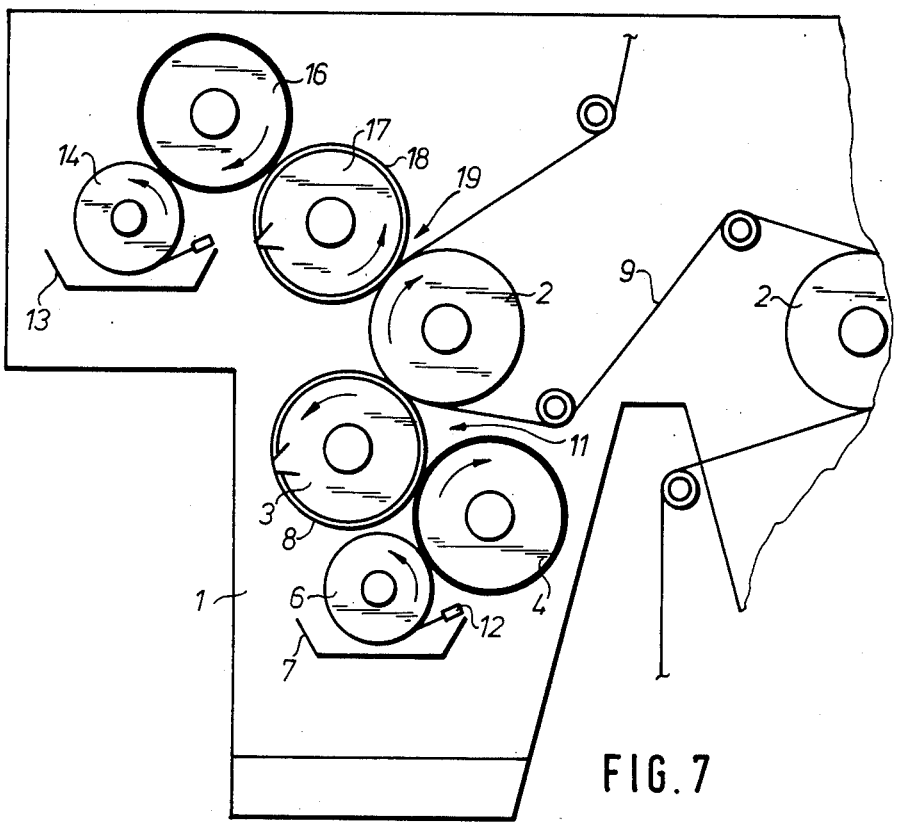
FIG. 7 is a schematic side elevation view of a printing unit having a supplemental printing couple in addition to a switchable printing couple in accordance with the present invention.

It is also contemplated by the present invention, as may be seen in FIG. 7, that a printing couple 11 in accordance with the present invention which is switchable between direct and indirect printing, could be utilized in combination with a conventional supplemental printing couple of known construction; i.e. one having an inking unit equipped with ink keys. In this arrangement, the conventional printing couple 19 which is comprised of an ink fountain 13 with ink keys, an ink fountain roller 14, an inking cylinder 16, and a forme or plate cylinder 17 that carries a printing plate 18 is situated adjacent the switchable printing couple 11 in accordance with the present invention and both contact the counter pressure cylinder 2 to print on a paper web 9. This embodiment thus shows a mixed construction type of printing machine comprising a flexographic printing unit without ink keys that is also useable for multi-color printing with known procedures such as letterpress or offset printing by using a technique known in the art such as ink keys and separate ink fountains for two or more colors. It will also be understood that an additional separate printing couple could be provided, as is shown partially at 2 in the right side of FIG. 7, so that both sides of paper web 9 could be printed thereby accomplishing recto and verso printing of the web 9.

While preferred embodiments of a switchable printing couple for newspaper and periodical printing in accordance with the subject invention have been fully and completely described hereinabove, it will be obvious to one of skill in the art that a number of changes in, for example, the specific materials used for the printing plates, the type of bearings and supports used, the specific drive means, and the like could be made without departing from the true spirit and scope of the invention which is accordingly to be limited only by the appended claims.

I claim:

1. A switchable printing couple adapted for being selectively switched between two printing modes with either direct inking of a soft printing plate or indirect inking of a hard printing plate, said printing couple comprising:

a counter pressure cylinder shiftably secured to spaced side frames of a printing unit and adapted to receive covers of selectable hardness which are securable to a peripheral portion of said counter pressure cylinder;

a plate cylinder having printing plate clamping means and adapted to selectively carry a hard or a soft printing plate secured to a surface thereof and cooperating with said counter pressure cylinder to print a web passing therebetween;

at least one plate inking cylinder having a resilient surface and being adjustably positionable in said side frames and adapted to be engagable with said plate cylinder when said plate cylinder carries said hard printing plate and being disengagable from said plate cylinder when said plate cylinder carries said soft printing plate;

a hard screen roller adjustably positionable in said side frames and adapted to selectively directly engage said plate cylinder when said plate cylinder carries said soft printing plate or to engage said at least one plate inking cylinder having a resilient surface when said plate cylinder carries said hard printing plate, the direction of rotation of said hard screen roller being reversed when said printing couple is switched between the two printing modes; and an ink fountain having no ink keys and into which said screen roller dips, said ink fountain supplying ink to the surface of said screen roller for transfer selectively directly to said soft printing plate or indirectly through said at least one resilient surfaced plate inking cylinder to said hard printing plate carried by said plate cylinder to print said web.

2. The printing couple of claim 1 wherein said plate cylinder said plate inking cylinder have equal diameters.

3. The printing couple of claim 1 wherein said soft printing plate is an elastic flexographic plate.

4. The printing couple of claim 1 wherein said hard printing plate is a letter press plate.

5. The printing couple of claim 1 wherein said at least one plate inking cylinder is removably carried in said side frames.

6. The printing couple of claim 5 wherein an axle distance between said plate cylinder and said screen roller is adjustable.

7. The printing couple of claim 5 wherein screen rollers of varying diameters are selectively positionable between said side frames.

* * * * *